United States Patent [19]

Zebedee et al.

[11] Patent Number: 4,640,052

[45] Date of Patent: Feb. 3, 1987

[54] HINGE BOLT SET

[75] Inventors: Alan R. Zebedee, New Milton; Derek R. Hutchins, Christchurch, both of England

[73] Assignee: Nouveaux Security Products Limited, Southhampton, England

[21] Appl. No.: 832,842

[22] Filed: Feb. 24, 1986

[30] Foreign Application Priority Data

Feb. 27, 1985 [GB] United Kingdom ..... 8505077

[51] Int. Cl.[4] ..... E05D 11/10

[52] U.S. Cl. ..... 49/383; 49/460

[58] Field of Search ..... 49/383, 384, 460, 462, 49/501; 16/273, 357, 230, 231

[56] References Cited

U.S. PATENT DOCUMENTS 2,489,072 11/1949 Ausubel ..... 49/460 X 3,636,659 1/1972 Bylicki ..... 49/383

4,063,330 12/1977 Triplette ..... 49/383 X

*Primary Examiner*—Philip C. Kannan

*Attorney, Agent, or Firm*—Silverman, Cass, Singer & Winburn, Ltd.

[57] ABSTRACT

A hinge bolt set is disclosed for improving security of hinged doors and the like, comprising a circular metal rod (1) adapted to be located in an edge face of a door (D) adajcent to but spaced from a hinge (H) and a synthetic resinous keep (7) adapted to be located in a opposing face of a door jamb (J), the keep having a tapered cavity (9) therein to receive a projecting end of the rod (1), which cavity terminates in an arcuate surface 13 to receive the bolt (1). The rod may be held in place by a knurled portion (3) and the keep with screws (17).

9 Claims, 1 Drawing Figure

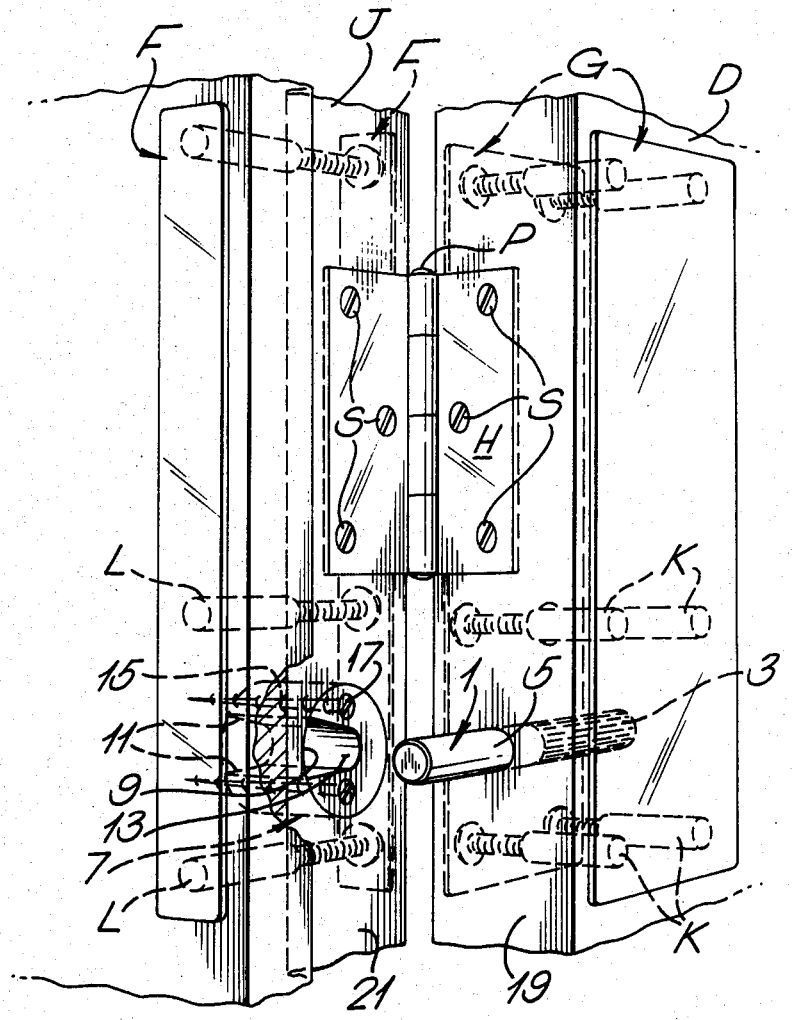
F
J
F
G
D
P
S
S
H
L
K
15
17
1
5
3
11
9
13
7
L'
K
21
19

HINGE BOLT SET

This invention relates to a hinge bolt set.

Hinge bolts are security devices which are fitted into the edge face of a door or the like to provide additional security along the edge of the door which is hingedly connected to the door frame. As it will be appreciated, without a hinge bolt set, security along the hinged edge of the door is dependent entirely upon the hinge connections. In other words, if the hinge pin fails or the screws holding the hinge to the door and the frame fail, or the frame or door fails in the vicinity of the screws, security is breached.

Known hinge bolts are normally inserted into the edge face of the door to which the hinges are connected so that the bolt projects by approximately 10–15 mm and a co-operating recess is formed in the adjacent jamb of the door frame so that when the door is closed the projecting portion of the bolt is located in the recess. Usually the recess is lined with a metal keep or keeper plate to provide additional strength. In order to provide the necessary strength the bolts themselves are normally formed of metal and this means that in operation there is metal-to-metal contact between the keep or keeper plate and the bolt. One major disadvantage with known hinge bolt sets is the poor penetration of the bolt into the aperture in the adjacent door jamb and into the edge of the door itself. This poor penetration means that it is relatively simple with the aid of a jemmy or other lever to cause deformation of the door or jamb by a sufficient amount to move the projecting portion of the bolt out of the influence of the keep or keeper plate. Another disadvantage with known hinge bolt sets is that it is normally necessary to taper the free projecting end of the hinge bolt so that as the door is swung to its closed position it can swing into the recess in the door without hitting the keep or keeper plate. This means that not only is there a small amount of penetration but also the tapering of the end of the bolt results in a considerably weakened bolt.

A type of hinge bolt set with tapering bolts is shown in No. US-A-1 391 304. This document discloses auxiliary metal hinge plates to which tapering metal bolts are connected, which cooperate with apertures in opposed auxiliary metal hinge plates. Behind the opposed auxiliary hinge plates, a tapered cavity is provided in the door/jamb. Such hinge bolt sets are expensive and difficult to fit, since they are formed integral with the hinge, and can suffer from damage when "attacked" due to metal to metal contact. Furthermore, apart from the apertured, opposed auxiliary metal hinge plate, the tapered cavity in the door or jamb is not reinforced to spread shock loading when subjected to attack.

The present invention seeks to provide a hinge bolt set which overcomes the disadvantages of known hinge bolts sets and which provides increased security in comparison with known hinge bolts sets. The hinge bolt set of the present invention has been particularly designed for use with the FRAMEGUARD the subject of our U.K. patent application No. 8314962 and with associated hinge guards.

One advantage of the hinge bolt set of the present invention over that shown in No. US-A-1 391 304 is that it can be retro-fitted to existing hinged doors, and that special hinges are not required.

According to the present invention, we provide a hinge bolt set comprising a rod of circular cross-section adapted to be inserted into an aperture in an edge face of a door or the like to which face hinges are normally connected and a keep adapted to be inserted into an aperture in the jamb of the door frame, said keep having a cavity therein extending from a side edge to a central portion thereof so as to permit during use the rod to move into the cavity, the inner end of the cavity terminating in an arcuate surface complementary with that of the rod and wherein either the rod or the keep is formed of a synthetic resinous material, and the other of said parts is formed of metal.

Preferably, the rod is of about 10 mm diameter and about 100 mm in length and in use is arranged with about 25 mm projecting from the edge face of the door into which the remainder has been inserted. Preferably, the rod is metallic. Preferably, the end of the rod which is inserted into the aperture in the edge face of the door is formed with knurling, the ridges of which increase the overall diameter of the rod relative to that of the unknurled portion. This means that the aperture can have a diameter corresponding to the unknurled portion of the rod so that the rod can be force-fitted into the aperture and be held in position by the knurling.

The keep may be formed from round bar stock having a diameter of about three times that of the rod and the cavity therein is defined by a pair of walls which diverge from the arcuate portion to the periphery of the keep.

Preferably, the keep is provided with at least two apertures therein to receive fixing screws. Instead of being formed from bar stock the keep, since it is formed of synthetic resinous material, could be injection moulded thus making it possible to form the cavity and the apertures therein during the moulding step. Preferred materials for the keep are polycarbonates such as LEXAN OR NORYL (RTMS) manufactured by General Electric Eng. Plastics and it is preferred that the bolt be formed of zinc-coated mild steel.

By forming the keep of a synthetic resinous material, it has some degree of resiliency and this means that if the hinge bolt set is subjected to shock loads, e.g. from a sledge hammer attack, with the bolt located in the keep, the resinous material of the keep will absorb some of these shock loads rather than re-act them back onto the bolt or the frame.

Because the inner end of the cavity is arcuate, so as snugly to embrace the surface of the bolt, any loads applied to the bolt are spread over the total bearing surface of the bolt and are not in the form of point loads as is normally the case with prior art hinge bolt sets.

A hinge bolt set according to the invention is now described by way of example with reference to the accompanying drawing, which is a perspective view of part of a door hingedly connected to a jamb, showing the hinge bolt set in position.

Referring to the drawing, part of a door D is shown connected by hinges, one of which is illustrated at H, to a jamb J forming part of a door frame. The hinge H is fixed to the door D and jamb J by screws S and the two leaves of the hinge H are pivotally connected together by a hinge pin P. The above is a description of a standard door hinge arrangement, and when the door is shut, the security of the door depends on the strength of the pin P and of the screws S, and if these hold, of the jamb J and door D. There is a tendancy for wooden door frames and doors to split in the vicinity of hinge fixing screws when they are subjected to forced entry attack, e.g. with a jemmy or sledge hammer, and such damage can be reduced or even prevented by fitting frameguards F and hingeguards G. These are the subject of our pending U.K. and European patent applications, Nos. 8314962 and 84305690.4 respectively. Of course, when frameguards F and hingeguards G are provided, then the security of the door depends almost entirely upon the strength of the hinge pins H.

The hinge bolt set of the present invention considerably improves this security, and comprises a bolt 1 which is preferably about 100 mm long, and of about 12 mm diameter, formed of zinc coated mild steel and provided with longitudinally ribbed knurling 3 at one end, and a plain cylindrical end 5, with the overall diameter at the knurled end being slightly greater than that at the end 5, due to the upstanding ribs of the knurling 3. The hinge bolt set also comprises a keep 7 in the form of a cylindrical member having a cavity 9 therein extending from the arcuate periphery of the member inwardly to a central region, and having converging side walls 11 terminating in an arcuate end wall 13, the centre of curvature of which at least substantially corresponds to the longitudinal central axis of the keep 7. The cavity 9 extends from one end face of the keep to the opposite end face, and the radius of curvature of the arcuate end wall of the cavity 9 should be no less than the radius of the end 5 of the bolt 1, and preferably very slightly greater than it. Preferably, the diameter of the keep 7 is about three times that of the bolt 1. The keep is formed of a synthetic resinous material, such as LEXAN (polycarbonate) or NORYL (both RTMs), engineering plastic, each having a high impact strength, but cheaper materials, such as nylon, could be used and this allows it to be formed by an injection moulding operation, although it could be formed in other ways, e.g. by forming from bar stock. At least two longitudinally extending apertures 15 are formed therein to receive fixing screws 17.

As can be seen from the drawing, the hinge bolt set is designed to be fitted adjacent ot the door hinge H, and ideally, a set should be provided for each hinge H. The bolt 1 should be located in an aperture in the edge face 19 of the door D to which the hinge H is fitted, and when hingeguards G and frameguards F are provided, this aperture should be located between sets of fixing studs K passing through the door D and holding the face plates of the hingeguard G to the door D. The diameter of the aperture formed in the edge face 19 should be equal to that of the end 5 of the bolt 1 and its depth should be sufficient for it to accommodate at least two-thirds of the bolt 1. Ideally, for a 100 mm bolt, it should be about 75 mm deep, thus leaving about 25 mm of the end 5 of the bolt 1 projecting from the face 19 of the door. The bolt is force fitted into the aperture, e.g. with a hammer, so that the knurling 3 firmly grips the side of the aperture, and maintains the bolt 1 therein.

The keep 7 is located in a circular aperature formed in the outer face 21 of the jamb J, with the centre of this aperture being in line with that of the aperture for the bolt 1 when the door is shut, and its depth corresponding to that of the keep, and is held in place by the screws 17. Again, if a frameguard F is provided, the aperture for the keep 7 should be located between fixing studs L holding face plates of the frameguard F to the jamb J.

It will thus be seen from the drawing that when a door, to which a hinge bolt set of the present invention is fitted, is shut, the end 5 of the bolt 1 will swing into the cavity 9, and even if not exactly correctly aligned, it will be guided by the converging side walls 11, until eventually its arcuate loading face bears against the matching arcuate end wall 13 of the cavity when the door is closed.

Accordingly, if the shut door is subjected to attack, this will be resisted by the hinge bolt set. Because of the penetration of the end 5 of the bolt 1 into the keep 7 in the jamb J, and of the knurled end of the bolt into the door D, far greater security than with know hinge bolts is provided, and this is substantially increased when frameguards F and hingeguards G are also provided.

The bolt 1 is formed of steel for maximum strength, but by forming the keep of synthetic resinous material, e.g. polycarbonate and providing for approximately 180° contact between an end face of the bolt portion 5 and the wall 13, shock loads due to sledge hammer or jemmy attack are evenly spread, and absorbed by the high impact synthetic resinous material. This produces a far more secure arrangement than with known hinge bolt sets.

It will of course be understood that the present invention has been described above purely by way of example, and modifications of detail can be made within the scope and spirit of the invention.

For example, the bolt 1 could be formed of an impact resistant synthetic resinous material, and the keep could be metallic. Likewise, the shape and relative dimensions of the bolt and keep need not be as described, and the shape of the cavity in the keep could be different, provided it will allow the bolt to move into it when the door is closed. Although specifically designed for hinged doors, the set could also be used for sliding doors, or for windows or the like.

We claim:

1. A hinge bolt set comprising a rod of circular cross-section adapted to be inserted into an aperture in an edge face of a door to which face hinges are normally connected and a keep adapted to be inserted into an aperture in the jamb of a frame of the door, said keep having a cavity therein extending from a side edge thereof to a central portion thereof so as to permit the rod, during use, to move into and out of said cavity, the inner end of said cavity terminating in an arcuate surface complementary with that of said rod and wherein one of the rod and keep is formed of a synthetic resinous material, and the other of said parts is formed of metal.

2. A hinge bolt set according to claim 1 wherein said rod is metallic and said keep is formed of synthetic resinous material.

3. A hinge bolt set according to claim 1 wherein one end of said rod is formed with knurling.

4. A hinge bolt set according to claim 1, wherein said keep is round with a diameter of about three times that of said rod.

5. A hinge bolt set according to claim 1 wherein said cavity in said keep is defined by a pair of walls which diverge from said arcuate surface to the periphery of said keep.

6. A hinge bolt set according to claim 1 wherein at least two apertures are provided in said keep for fixing screws.

7. A hinge bolt set as claimed in claim 1 wherein said set is spaced from and separate from a hinge.

8. A door assembly comprising a door supported for movement between open and closed positions in a frame and provided with a hinge bolt set as claimed in claim 1 wherein approximately two-thirds of said bolt is located in an aperture formed in an edge face of said door and wherein said keep is located in said jamb of said door frame in line with said bolt so that when said door is closed, a projecting portion of said bolt is located within said cavity in said keep.

9. A door assembly as claimed in claim 8 wherein said door is pivotally connected to said jamb by means of one or more hinges and wherein said hinge bolt set is provided adjacent said hinge, and a pair of plates is fitted to the faces of said door in the vicinity of the hinge to act as a hingeguard and in which that portion of said bolt which is located within said door is arranged between said pair of plates and wherein a further pair of plates is fitted to opposite faces of the jamb and provides a frameguard, and said keep is located between said further pair of plates.

* * * * *